United States Patent [19]

Hayashi et al.

[11] Patent Number: 4,683,118

[45] Date of Patent: Jul. 28, 1987

[54] PROCESS AND APPARATUS FOR MANUFACTURING A PRESSED POWDER BODY

[75] Inventors: Chikara Hayashi, Chigasaki; Seiichiro Kashu, Yachimata, both of Japan

[73] Assignee: Research Development Corporation of Japan, Tokyo, Japan

[21] Appl. No.: 785,683

[22] Filed: Oct. 9, 1985

[30] Foreign Application Priority Data

Oct. 9, 1984 [JP] Japan ..... 59-210366

[51] Int. Cl.[4] ..... B22F 7/00

[52] U.S. Cl. ..... 419/23; 419/6; 419/7; 419/8; 419/9; 419/48; 419/66; 264/60; 264/65; 264/121; 264/123; 264/332

[58] Field of Search ..... 264/60, 65, 121, 122, 264/123, 332; 425/78, 447; 419/6, 7, 8, 9, 48, 66, 23

[56] References Cited

U.S. PATENT DOCUMENTS 3,165,570 1/1965 Deutsch ..... 264/121

4,460,529 7/1984 Schultze ..... 264/121

OTHER PUBLICATIONS

Kashu et al, Deposition of Ultra Fine Particles Using a Gas Jet; Japanese Journal of Applied Physics, vol. 23, No. 12, pp. L910–L912, Dec. 1984.

*Primary Examiner*—Stephen J. Lechert, Jr.

*Attorney, Agent, or Firm*—Armstrong, Nikaido, Marmelstein & Kubovcik

[57] ABSTRACT

A process and apparatus for producing a pressed powder body from at least two different kinds of ultrafine particles. Ultrafine particles of at least two different materials are uniformly mixed together and the mixture is sprayed onto an objective surface whereby the spray pressure causes the particles to adhere and form the pressed powder body. The apparatus includes mixing means, means for conveying the mixture of ultrafine particles, and a pressed powder body forming chamber including nozzle means for spraying the mixture of ultrafine particles, an objective surface and means for evacuating the chamber and introducing an inert gas therein.

6 Claims, 7 Drawing Figures

PROCESS AND APPARATUS FOR MANUFACTURING A PRESSED POWDER BODY

BACKGROUND OF THE INVENTION

1. Field of the Invention

This invention relates to a process and an apparatus for manufacturing a pressed powder body from ultrafine particles.

2. Description of Relevant Information

It has been hitherto known that where it is required for a structural material to have predetermined characteristics such as predetermined strength, hardness, toughness, durability, etc., there is manufactured, by a conventional forming process such as a melting cast process, a sintering process or the like, an integral composite product comprising any kind of metal or any kind of alloy constituting the main component of the product and any different kind of metal, alloy or compound such as a metallic oxide or the like.

For obtaining a product having predetermined characteristics, it is necessary to manufacture a lump or agglomerate product having a uniform structure comprising a mixture, for example, of two different metals or a metal and a compound such as an oxide. A product meeting this requirement cannot be obtained by conventional manufacturing processes. Namely, in the foregoing lump forming process, metallic particles and compound particles, after being mixed together, are heated to be brought into a molten condition thereof or are subjected to a high temperature-elevated sintering condition that causes extremely vigorous moving and dispersing between atoms thereof, so that the particles are mutually fused together, and thereby a predetermined dispersed condition of the particles at the time of mixing thereof is easily destroyed to result in a composite product comprising an extremely non-uniform mixed structure of different kinds of materials. Thus, it is difficult to maintain, at a final stage of the process, a predetermined structure which uniformly possesses suitable predetermined characteristics.

To cite concrete examples, for manufacturing a dispersed reinforced alloy composite product, it is necessary, for example, to disperse ultrafine particles of metallic oxide in a metallic matrix. In this case, however, a mixture thereof is heated for several minutes to a high temperature that is at least 60% higher than the melting point of the metallic material, so that it is difficult to presume the characteristics of the product after being solidified or cooled. In the case of a melting cast process, the influence on a cast product caused by segregation due to gravity while maintaining the molten condition thereof cannot be neglected. In the case of a sintering process, it is difficult to obtain a uniform mixture of components of a composite product at the time of mixing thereof before the mixture is formed into a sintered product, and additionally there is caused growing of the particles at a temperature of above about 500° C. Consequently, there cannot be obtained a lump form product having a uniform composite structure.

The present invention has for an object to provide a manufacturing process which can avoid the foregoing defects of the conventional processes, and which can obtain a predetermined uniform mixing condition and produce a pressed powder body comprising a lump form product having a predetermined uniform composite structure without changing the foregoing predetermined mixing condition obtained by the mixture.

Additionally, this invention has as another object to provide a process for manufacturing a pressed powder body which has a predetermined uniform structure and is higher in density or compactness and more excellent in various characteristics than products produced by conventional processes.

The present invention has as a further object to provide a manufacturing apparatus which is made in relation to each of the foregoing processes and is suitable for carrying out the same.

SUMMARY OF THE INVENTION

The foregoing and other objects are met by the process and apparatus according to the present invention.

The process of the invention is characterized in one embodiment in that at least two kinds of ultrafine particles are mixed together in a carrier gas, and then the resultant mixture gas is sprayed onto an objective surface, so that there may be formed thereon, by the pressure of the spraying, a pressed powder body comprising an aggregated solid lump of the ultrafine particles.

In another embodiment the process of the invention is characterized in that at least two kinds of ultrafine particles are mixed together in a carrier gas, and then the resultant mixture gas is sprayed onto an objective surface so that there may be formed thereon, by the spraying pressure, a pressed powder body comprising an aggregated solid lump of the ultrafine particles. The resultant pressed powder body is then subjected to a pressing operation as it is or in an enveloped condition, either without being heated or while being heated at a comparatively low temperature.

The apparatus of the present invention is characterized as including means for producing at least two different kinds of ultrafine particles, means for mixing the ultrafine particles in a carrier gas, means for forming the pressed powder body, means for conveying the mixture of ultrafine particles to said forming means; the forming means including a nozzle for spraying the ultrafine particles and which is rotatable eccentrically and movable upwardly and downwardly, an objective surface which is also movable upwardly and downwardly and a tubular guide surrounding the circumference of the objective surface.

DESCRIPTION OF PREFERRED EMBODIMENTS

Figure 1:
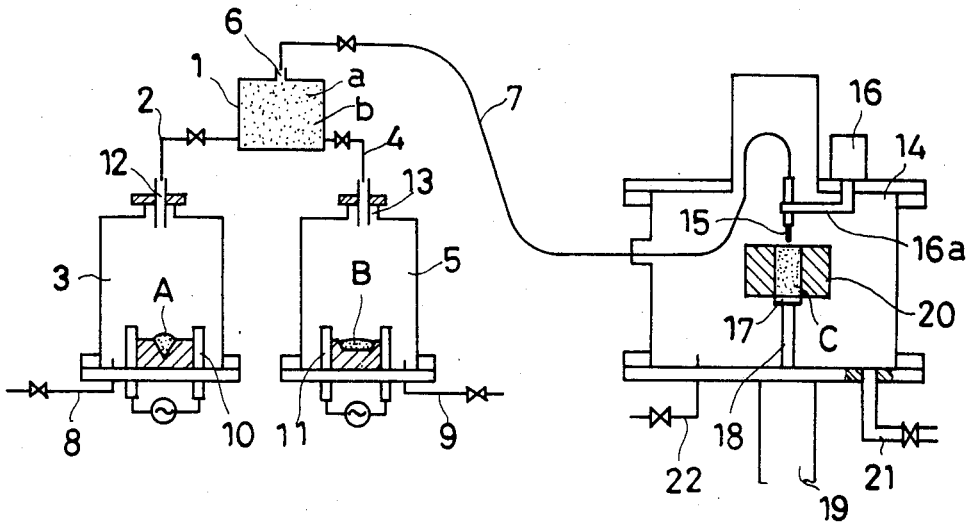
FIG. 1 is a diagram showing one embodiment of the apparatus for carrying out the process of the present invention.

Referring to the drawings, a mixing chamber 1 for mixing together at least two kinds of ultrafine particles is connected on one side thereof, through a raw material conveying pipe 2, to an ultrafine particle producing chamber 3, and is connected on the other side thereof, through a raw material conveying pipe 4, to an ultrafine particle producing chamber 5. In ultrafine particle producing chamber 5, ultrafine particles different in kind from the raw material, that is, the ultrafine particles produced in the chamber 3, are produced. A mixture gas conveying pipe 7 is connected to a top opening portion 6 of the mixing chamber 1.

Figure 2:
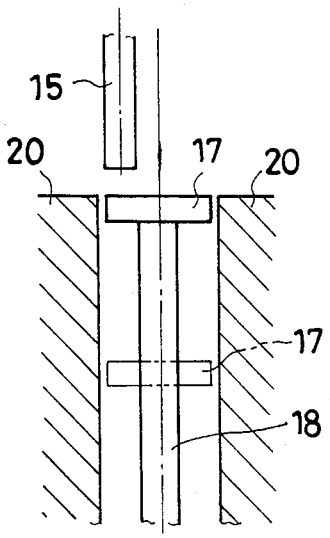
FIG. 2 is an enlarged sectional side view of a portion of the apparatus of FIG. 1.

Respective carrier gas introducing pipes 8 and 9 for any desired gas such as an inert gas are connected to the respective producing chambers 3 and 5. Chambers 3 and 5 are provided at respective bottom portions thereof with heating means 10 and 11 so that raw materials A and B of mutually different kinds selected from metals, alloys, compounds such as metallic oxides, synthetic resins, or the like prepared in these chambers can be heated and evaporated by the respective heating means 10, 11 to produce ultrafine particles thereof. Openings 12 and 13 are made in top walls of the chambers 3 and 5 for communicating with the respective conveying pipes 2 and 4. A forward end portion of the mixture gas conveying pipe 7 is introduced into an adjacent pressed powder body forming chamber 14. The pipe 7 has at its forward end a spraying nozzle 15 directed downwards. The nozzle 15 is connected at its base portion, through a holding arm 16*a*, to a nozzle eccentric rotation system means 16 so that the same may be rotated eccentrically to form a pressed powder body comprising uniformly mixed ultrafine particles and having a diameter which is much larger than the caliber of the nozzle 15. An adhesion plate 17 in the form of a circular disc or the like and of a proper size is provided below the nozzle 15 so as to face the same. Additionally, the adhesion plate 17 is supported so as to be movable upwardly and downwardly on an elevating rod 18 which is connected at its upper end to a lower surface of the plate 17. The elevating rod 18 projects through a bottom wall of the chamber 14 and is arranged to be driven by an elevating driving means 19 provided therebelow. A hollow tubular guide wall 20 is provided on an outer circumference of an upper and lower moving path of the adhesion plate 17 so that as shown clearly in FIG. 2, at the time of forming of the pressed powder body, the adhesion plate 17 may be first located at an upper end of the tubular guide wall 20 and then gradually lowered as shown by chain lines during the course of forming the pressed powder body. Thus, a pressed powder body of a column form of a predetermined length may be formed on the upper surface of the plate 17.

Usually, the gap between the lower end of the nozzle 15 and the adhesion plate 17 is extremely small and is generally maintained in a range of about 0.1–3.0 mm; preferably, 0.5–2 mm, in order that a strong spraying pressure of the spraying nozzle 15 may be applied to the adhesion plate 17. As the mixed ultrafine particles are thereafter sprayed and deposited on the upper surface of the adhesion plate 17, the adhesion plate 17 is moved downwardly so as to keep such a small gap range as substantially equal to the foregoing one between the nozzle 15 and the surface of the pressed particle body being formed.

For example, in a particular embodiment the diameter of the upper surface of the adhesion plate 17 is 3 mm, the caliber of the forward end of the nozzle is 0.6 mm, and the eccentric degree thereof is about 1 mm. The adhesion plate 17, the elevating rod 18 and the tubular guide wall 20 may be provided with a temperature control mechanism (not illustrated) for controlling them to a desired temperature ranging from about −60° C. to 150° C. by means of liquid nitrogen, water, a heater or the like.

It is usual that the pressed powder body forming chamber 14 is connected on one side thereof, through a connecting pipe 21, to a vacuum pump (not illustrated) and is connected on its other side to an inert gas introducing pipe 22 so that at the time of operation thereof the interior of the chamber 14 may be kept at a proper vacuum or additionally an inert gas such as Ar or the like may be introduced therein as occasion demands. However, it is possible for the chamber 14 to be used under an atmospheric pressure, depending on the kind of the ultrafine particles used in the process.

Next, a manufacturing process of a pressed powder body by operation of the foregoing apparatus will be described.

A metal A, for example, is prepared in the ultrafine particle producing chamber 3, and is heated at a predetermined temperature to produce a vapor thereof and an inert gas is introduced through the carrier gas introducing pipe 8 and causes the vapor to be introduced into the mixing chamber 1 from one side thereof. At the same time, a metallic oxide B, for example, is prepared in the ultrafine particle producing chamber 5, and is heated at a predetermined temperature to produce a vapor thereof. A gas which does not react with he foregoing metal vapor is introduced through the carrier gas introducing pipe 9 to cause the oxide vapor to be introduced into the mixing chamber 1 from the other side thereof, whereby the two kinds of ultrafine particles a, b in a predetermined composition ratio are mixed together uniformly in the mixing chamber 1 by the carrier gases. The mixing ratio of these two kinds of vapors, that is, ultrafine particles is properly set by properly adjusting the heating of the producing chambers 2 and 5, and the amount of the carrier gases introduced through the introducing pipes 8 and 9. The two kinds of ultrafine particles a, b are easily flown, or fluidized, and agitated and are mixed together in a fluidized condition in the mixing chamber 1 by the carrier gases, so that there may be obtained a mixture wherein the mixing ratio of the ultrafine particles is equal at every portion thereof. The mixture thus obtained is sent under pressure through the conveying pipe 7, by a conveying pressure generated in the mixing chamber 1, and is sprayed or jetted under a strong spraying pressure from the nozzle 15 of the forward end of the conveying pipe 7 against the upper surface of the adhesion plate 17 positioned in front thereof. A gap of 1 mm, for instance, is maintained between the end of the nozzle 15 and the adhesion plate 17 and, the mixture of the ultrafine particle a, b uniformly mixed as mentioned above is caused to adhere under pressure to the surface of the plate 17 and is gradually accumulated thereon.

During this operation, the nozzle 15 is rotated eccentrically, so that there can be obtained an accumulated layer of the ultrafine particles which is uniform in thickness over the whole surface of the adhesion plate 17.

Prior to this spraying procedure, the interior of the pressed powder body forming chamber 14 is maintained at 1 Torr, for instance, by evacuating the chamber by the vacuum pump or by properly controlling the balance between the evacuation capacity and the amount of inert gas introduced into the chamber.

As the spraying continues, the pressing adhesion accumulation caused by the spraying of the mixed ultrafine particles is continued in such a manner that the adhesion plate 17 is gradually lowered while maintaining the gap of 1 mm between the nozzle 15 and the surface of the accumulated layer, and as a result there is obtained in the tubular guide wall 20 a pressed powder body c comprising a single column-shaped aggregated solid lump of the ultrafine particles as shown in FIG. 1. Thus, the pressed powder body c is formed by gradually depositing the ultrafine particles under a strong pressure caused by spraying, and consequently there is produced a pressed powder body c comprising a firmly aggregated solid lump that is not easily broken and in which the ultrafine particles thereof are strongly combined, or bound, together, even without being heated.

Since the body c comprises ultrafine particles, if it is desired to sinter the pressed powder body c, the deposited ultrafine particles are heated at a comparatively low temperature of preferably below 100° C., for instance, which makes it possible to effect mutual fusion of only the surfaces of the ultrafine particles. Thus, the mixed ultrafine particles can be formed into a sintered pressed powder body in which the mixing structure condition remains as it is in the predetermined uniform mixing structure condition.

Figure 3:
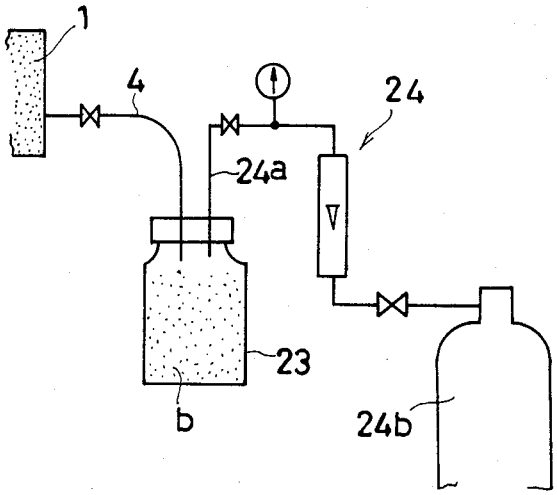
FIG. 3 is a sectional side view of a part of a modified example of FIG. 1.

Instead of the foregoing manufacturing process, a modified manufacturing process is possible wherein the ultrafine particles are previously, or separately, produced and are thereafter introduced into the mixing chamber. A manufacturing apparatus for carrying out this manufacturing process can be constructed such that, in place of one or both of the ultrafine particle producing chambers 3 and 5, one of them as shown in FIG. 3, is replaced by a container 23 which contains therein ultrafine particles previously produced. A discharging opening thereof is connected through the conveying pipe 4 to the mixing chamber 1. An introducing pipe 24*a* for an external carrier gas supplying means 24 is connected to an introducing opening of the chamber 23 so that the carrier gas may be introduced into the container 23 from the carrier gas source 24*b* at a proper pressure and flow rate for conveying the ultrafine particles b contained in the container 23 to the mixing chamber 1.

The pressed powder body c thus manufactured is obtained as one comprising a predetermined structure having a mixing ratio of two kinds of the ultrafine particles which is equal to the mixing ratio thereof prepared in the mixing chamber 1 where the two kinds of ultrafine particles are mixed together uniformly at any point in the interior of the chamber 1. Therefore, there can be manufactured by the process of this invention a pressed powder body of which the characteristics or the like can be previously determined.

If a precious metal such as Ag, Au or the like is converted into a vapor of ultrafine particles thereof under a high purity gas atmosphere, and the ultrafine particles are conveyed and sprayed by the gas and formed into a pressed powder body thereof, sintering between the ultrafine particles is advanced, extremely slowly, even at 0° C. If such a sintering is not desired, the pressed powder body thereof can be manufactured under a condition that the adhesion plate 17 and the tubular guide wall 20 are cooled by a cooling medium maintained below 0° C., for instance, down to about −60° C., when considering prevention of the influence thereon by the vapor pressure of water vapor.

The pressed powder body obtained as above is a comparatively porous one, and as desired, the same may be formed into a pressed powder body with a high density by compression by taking the pressed powder body out from the chamber 14 and applying pressure by any proper means. In this case, depending on the kind of ultrafine particles, the body, if taken out of the chamber 14, may be oxidized or burned. For such a body, it is necessary that the pressed powder body is enveloped hermetically by a proper material in the chamber 14 before being removed.

Figure 4:
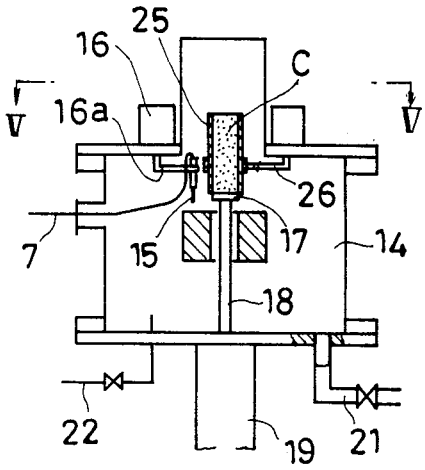
FIG. 4 is a sectional side view of a pressed powder forming chamber having an enveloping means for a pressed powder body.
Figure 5:
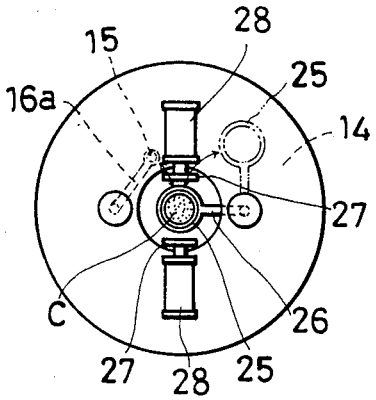
FIG. 5 is a sectional view taken along the line V—V in FIG. 4.

FIGS. 4 and 5 show a pressed powder body forming chamber 14' having a covering and hermetically sealing means for achieving the foregoing purpose. The arm 16*a'* holding the base portion of the nozzle 15' is arranged to be turnable in the horizontal direction as illustrated, so that the same, when not in use, may be retreated sideways from its predetermined position which is above the adhesion plate 17'. Additionally, a supporting arm 26' holding an enveloping tube 25' which is made of a soft and tough metal such as Al, Cu, etc., or of a thermoplastic synthetic resin and has a size large enough to contain and hermetically seal the column-shaped pressed powder body c is provided turnably in the horizontal direction in the chamber 14'. Additionally, a pair of pushing rods 27', 27' facing one another for clamping an upper end portion and a lower end portion of the enveloping tube 25' for hermetically closing upper and lower opening ends thereof are so provided as to be movable to advance and retreat. Air-pressure cylinders, 28', 28' are provided for driving the pushing rods 27', 27'. The remaining parts of the chamber 14' are not substantially different from the pressed powder body forming chamber shown in FIG. 1.

The operation of the foregoing hermetically enveloping means is as follows.

Firstly, in order to envelope the column-shaped pressed powder body c', the nozzle 15' is retreated sideways from its position above the adhesion plate 17' by means of the nozzle holding arm 16*a'*. Thereafter, the covering tube supporting arm 26' is turned so that the enveloping tube 25' is positioned on the center line of the column-shaped pressed powder body c' formed on the adhesion plate 17' as illustrated. Under this condition, the elevating rod 18' is moved upwardly until the pressed powder member C' is inserted into the covering tube 25'. Under this condition, the upper end portion of the enveloping tube 25' is clamped under pressure by advancing the pair of opposite pushing rods 27', 27'. The upper end portion of the enveloping tube 25' is so flattened under pressure that the opening end portion thereof is closed air-tight. On this occasion, the pressed powder body c' is held by the flattened upper end portion. Next, after the pushing rods 27', 27' are slightly retreated, the elevating rod 18 i's further moved upwardly so that the lower end portion of the enveloping tube 25' may be located at a position facing the pair of pushing rods 27', 27'. Thereafter, the elevating rod 18' is lowered to retreat from the lower end of the enveloping tube 25', and the lower end portion of the covering tube 25' is clamped and flattened by advancing the push rods 27', 27', so that the open end portion thereof is hermetically closed.

In a case where the enveloping tube 25 to be used is a synthetic resin, a heat seal means (not illustrated) is additionally provided so that the flattened portions of the upper end portion and the lower end portion may be sealed by heat. Thus, after the air-tight enveloping of the pressed powder body c' is completed, the forming chamber 14' is released from its vacuum condition, and thereafter the hermetically enveloped pressed powder body c' is removed.

Figure 6:
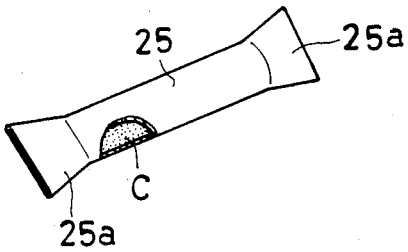
FIG. 6 is a perspective view, partly omitted, of an enveloping tube air-tightly sealing therein a pressed powder body.
Figure 7:
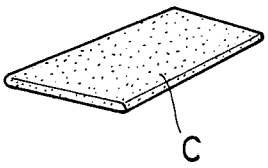
FIG. 7 is a perspective view of a pressed powder body with a high density.

FIG. 6 shows one example of the hermetically enveloped pressed powder body c'. Numerals 25a', 25a' denote flattened sealed portions formed on both ends of the metallic covering tube 25'. The hermetically enveloped pressed powder body c' is then subjected to a desired working treatment such as a cold hydrostatic pressing, a warm hydrostatic pressing, a cold rolling, a warm rolling of the like, so that the pressed powder body c' is compressed and formed into a non-porous, compact and high density pressed powder body (FIG. 7). In this case in order to obtain a high density pressed powder body (bulk material) without collapsing the predetermined uniformly mixed composite structure constituting the pressed powder body c', and in a case where it is desired to be heated, the body c' is heated at a temperature below 200° C., and more preferably below 150° C. Such a high density pressed powder body thus formed by compression becomes comparatively stable to the atmospheric air. Next, the covering tube 25' is opened by cutting or the like, and the high density pressed powder body c' is taken out therefrom, and the same is further subjected, if required, to a desired working such as rolling, heating-pressing or the like. If it is required that the high density pressed powder body c' is subject to working such as hot pressing or the like, without being exposed to the atmospheric air, the hermetically enveloped pressed powder body c' can be placed into a glove box having its atmosphere similar to that of the foregoing chamber 14'. The body c' is taken out from the covering tube in the glove box and is subjected therein to a desired working treatment such as pressing, heating-pressing or the like.

The materials for the ultrafine particles can be selected from any of the metals, alloys, synthetic resins or inorganic compounds suitable for forming a pressed powder body by means of pressure produced by spraying the ultrafine particles onto an objective surface. These materials include oxides such as $Al_2O_3$, $SiO_2$ or the like, a carbide of Ti, Si or the like, a nitride of Ti, Si or the like, and synthetic resins such as vinyl chloride, nylon or the like. Two or more kinds of these materials are properly selected and are mixed together in a predetermined mixing ratio by carrier gases, so that there can be formed various pressed powder bodies of various kinds of composite materials.

The "ultrafine particles" used in the process of the present invention are produced by methods known per se (for example, as described above) and generally have a particle size of from about 0.001$\mu$ (10 Å) to about 1$\mu$. These particles are sprayed through nozzles having a caliber, or internal diameter (aperture) of from about 0.01 mm (1$\mu$) to about 3 mm. The ultrafine particles are projected through the nozzle onto the objective surface at a speed of about 5 m/sec. to about 500 m/sec.

In the foregoing examples, there has been described the embodiment where two kinds of ultrafine particles are introduced into a mixing chamber and are mixed together. However, in a case where three kinds of ultrafine particles, for instance, are to be mixed together, there is added to the apparatus shown in FIG. 1 or that shown in FIG. 3 another ultrafine particle producing chamber or another mixing chamber which is connected to the first mixing chamber.

A specific embodiment of the process and apparatus of the invention for manufacturing a reinforced nickel pressed powder body in which alumina ultrafine particles of 1–3% by weight are uniformly dispersed in a matrix of Ni ultrafine particles is described below.

The foregoing apparatus in FIG. 3 is used. Ni metal is heated and evaporated in the ultrafine particles producing chamber 3, and the resultant vapor is introduced into the mixing chamber 1 by a carrier gas of Ar introduced into the chamber 3, such that the carrier gas flow rate is 0.45 liter/min. and the conveyed Ni ultrafine particle flow rate is 12.6 mg/min. On the other hand, a predetermined amount of highly pure $\alpha$-alumina ultrafine particles available on the market (average particle diameter is 0.6 micron, and specific surface area is 20 $m^2/g$) are provided in the container 23 shown in FIG. 3, and Ar gas is introduced into the container 23 from the carrier gas supplying means 24, whereby the alumina ultrafine particles are agitated and fluidized in the container 23. The alumina ultrafine particles are introduced into the mixing chamber 1 under a flow rate of the Ar gas serving as the carrier gas for uniformly carrying the ultrafine particles of 0.1 liter/min. and a flow rate of the alumina ultrafine particles of 0.25 mg/min. Thus, there is created in the mixing chamber 1 a mixture wherein the two kinds of ultrafine particles are uniformly distributed and mixed at the predetermined mixing ratio. This mixture is sprayed from the nozzle 15' introduced into the pressed powder forming chamber 14' shown in FIGS. 4 and 5, through the conveying pipe 7', against the surface of the adhesion plate 17' of 3 mm in diameter facing the nozzle 15', while leaving a gap of 1 mm, for instance, therebetween. The foregoing Ni ultrafine particles are produced under conditions wherein the Ni is heated by an $Al_2O_3$ coated basket type tungsten heater (heating power 750W) under an Ar atmosphere so that Ni ultrafine particles are evaporated at a production rate of 80 mg/min. The interior of the pressed powder body forming chamber 14' is previously subjected to evacuation by a vacuum pump and introduction of Ar gas so as to be kept at a vacuum degree of 0.07 Torr under an Ar atmosphere. The nozzle 15 is 0.6 mm in inner diameter, and the spraying of the mixed ultrafine particles is carried out while the nozzle 15' is rotated by the nozzle eccentric rotation system means 16' at a speed of 5 rpm and with an eccentric amount of 1 mm. Meanwhile, the adhesion plate 17' is lowered at a speed of 0.37 mm/min., while maintaining a gap of 1 mm between the nozzle 15 and the upper surface of the accumulated or deposited layer of the mixed ultrafine particles adhered to the adhesion plate 17, to form a column-shaped pressed powder body. By this spraying operation, there is obtained a column-shaped pressed powder body of 3±0.1 mm in diameter and 42 mm in length. It has been confirmed that this pressed powder body has a weight of 1.48 g and a density ratio of 56%, and is such a solid lump pressed powder body that the Ni ultrafine particles and the alumina ultrafine particles are mixed together uniformly at a predetermined mixing ratio throughout the body and are firmly aggregated together so as not to be easily collapsed in shape. The value of the foregoing density ratio is an extremely high value for a formed body obtained at a normal or room temperature without pressure being applied thereto, so that such a high compact product is stable and raises no problem in any subsequent treatment.

In order to place the pressed powder body thus manufactured into the covering tube 25' which is made of annealed high pure copper and is 3.8 mm in outer diameter, 3.3 mm in inner diameter and 90 mm in length, the holding arm 16a' is turned to retreat the nozzle 15' sideways, and the covering tube 25' is set at a position where the nozzle 15' was previously located, that is, the position just above the pressed powder body c', by turning of the holding arm 26. Under this condition, the elevating rod 18' is moved upwardly so that the pressed powder body c' may be inserted into the covering tube 25' as shown in FIG. 5. The upper end of the tube 25' is clamped under a pressure of about 70 kg by the pushing rods 27', 27' to be formed into a flattened air-tight sealed end 25a' of 5 mm in width. Thereafter, the elevating rod 18' is further moved upwardly, and in almost the same manner as above, the lower end of the tube 25' is flattened by the pushing rods 27', 27' to be formed into a flattened air-tight sealed end 25b', so that the pressed powder body c' is enveloped hermetically therein. The hermetically enveloped pressed powder body c' is taken out of the forming chamber and exposed to the atmospheric air, and is subjected to a pressing treatment of 1000 kg/cm$^2$ in pressure and 10 min. in holding time by a hydrostatic pressing machine to obtain a high density pressed powder body. It may be also considered that the body may be subjected to a hot pressing of 1000 kg/cm$^2$ in pressure and 10 min. in holding time under a heated condition of 100° C. for obtaining a high density pressed powder body.

Thereafter the covering tube 25 is broken open so as to take out therefrom the highly dense pressed powder body. Thus, there is obtained a compressed body of 2.6±0.1 mm in diameter and 36 mm in length, and the density rate thereof has been found to be increased to 87%.

The value of this density ratio is equal to that of a sintered Ni product manufactured by a conventional process in which Ni ultrafine particles of several ten - several hundred microns in particle diameter are used as starting raw materials and are heated and pressed at a pressure of 2000-3000 kg/cm$^2$ and at a temperature of 800°-1000° C., and thus it has been recognized that the present invention can produce a high density product in spite of extremely lower pressures and temperatures than the conventional processes. Additionally, owing to the fact that the pressed powder body is heated at a low temperature according to this invention, the uniform mixing structure of the pressed powder body before being pressed can be maintained in the high density product without collapsing. This highly dense and uniformly dispersed reinforced nickel pressed powder body has the characteristics as shown in the following table.

Table

Tensile strength: 49 kg/mm$^2$
Proof stress: 17 kg/mm$^2$
Elongation: 16%

It has been confirmed by a microscopic observation that the Ni ultrafine particles are not melted together to form larger particles, and the $Al_2O_3$ ultrafine particles are uniformly dispersed in the matrix of Ni ultrafine particles.

As will be clear from the above Table, the tensile strength and the proof stress thereof are more excellent than those of a rolled Ni sheet material.

In order that this invention pressed powder body with such a high density may be further processed into an expanded material, the same is again hermetically enveloped in a copper covering tube, and is rolled in the atmospheric air while being heated to 100° C. Next, the covering tube is dissolved by immersion in 30% nitric acid in order to obtain the pressed powder body in the sheet form. The product is 1.4 mm in thickness, 3.3 mm in width, 36 mm in length and 98.8% in density ratio.

For obtaining an Ni product having this density rate by a conventional sintering process, it is necessary to press and heat the sintered material at a temperature of about 1000° C.

The foregoing highly dense and $Al_2O_3$- dispersed Ni pressed powder body of this invention subjected to a low temperature hot rolling treatment is improved by about 30% in its tensile strength and its proof stress in comparison with the spread and elongated material Ni, and is substantially equal thereto in elongation.

Thus, according to this invention, at least two kinds of ultrafine particles are mixed together by carrier gases, and thereafter the resultant mixture is sprayed onto an adhesion surface, so that there can be obtained a hard agglomerate of pressed powders wherein the combined ultrafine particles are mixed together uniformly over the whole range thereof. In addition, by compressing the pressed powder body of ultrafine particles without heating or while heating at a low temperature, there can be obtained a pressed powder body of higher density and higher strength while at the same time maintaining the uniformly mixed structure condition. Additionally by applying thereto a pressing, a rolling or the like under a hermetically sealed condition, there can be obtained a predetermined composite pressed powder body without being oxidized.

What is claimed is:

1. A process for producing a pressed powder body comprising mixing together ultrafine particles having a diameter of 0.001 $\mu$-1 $\mu$ of at least two different materials in a carrier gas and spraying the mixture of ultrafine particles in the carrier gas onto an objective surface such that there is formed by the pressure of the spraying a pressed body comprising an aggregated solid the mass of the ultrafine particles wherein the ultrafine particles of the different materials are mixed together uniformly throughout the whole aggregated solid mass.

2. The process of claim 1 further comprising subjecting said pressed powder body to a pressing operation.

3. The process of claim 2 wherein said pressed powder body is hermetically sealed prior to the pressing operation.

4. The process of claim 2 wherein said pressing operation is performed while heating said pressed powder body.

5. An apparatus for producing a pressed powder body comprising means for mixing ultrafine particles of at least two different materials in a carrier gas; a pressed powder body forming chamber connected to the mixing means by a mixture conveying pipe; a spraying nozzle provided in the pressed powder body forming chamber and at a forward end of the mixture conveying pipe; means for eccentrically rotating said nozzle about an axis parallel to the axis of the spraying nozzle and for moving said nozzle upwardly and downwardly in the direction of said nozzle axis; an objective surface provided in said pressed powder body forming chamber and being movable upwardly and downwardly in the direction of said nozzle axis and a tubular guide means surrounding the circumference of said objective surface.

6. The apparatus of claim 5 further comprising means for holding an enveloping tube for holding a pressed powder body therein; means for closing, by clamping, the ends of said enveloping tube; means for introducing an inert gas into said pressed powder body forming chamber and means for evacuating the pressed powder body forming chamber.

* * * * *